US006653770B1

(12) United States Patent
Matsuba et al.

(10) Patent No.: US 6,653,770 B1
(45) Date of Patent: Nov. 25, 2003

(54) LAMP WITH INTERNALLY ATTACHED EYELET LEAD, AND METHOD THEREFOR

(75) Inventors: Tetsuo Matsuba, Neyagawa (JP); Takeshi Matsumura, Kashiwara (JP); Shinichiro Ishitsuka, Osaka (JP)

(73) Assignee: Matsushita Electric Industrial Co., Ltd. (JP)

( * ) Notice: Subject to any disclaimer, the term of this patent is extended or adjusted under 35 U.S.C. 154(b) by 286 days.

(21) Appl. No.: 09/619,654

(22) Filed: Jul. 19, 2000

(30) Foreign Application Priority Data

Jul. 28, 1999 (JP) ..... 11-213293

(51) Int. Cl.[7] ..... H01J 5/48; H01J 5/50; H01K 1/00

(52) U.S. Cl. ..... 313/318.04; 313/318.12; 313/318.1; 439/613; 439/615

(58) Field of Search ..... 313/318.01–318.12, 313/331–335, 623–626; 445/26, 48, 27; 439/613, 615

(56) References Cited

U.S. PATENT DOCUMENTS 2,336,529 A * 12/1943 Cartun ..... 403/329
5,568,009 A * 10/1996 Gandhi ..... 313/318.01

FOREIGN PATENT DOCUMENTS

JP 59121757 A * 7/1984 ..... H01J/61/30
JP 4-94003 3/1992

* cited by examiner

*Primary Examiner*—Nimeshkumar D. Patel
*Assistant Examiner*—German Colón
(74) *Attorney, Agent, or Firm*—Parkhurst & Wendel, L.L.P.

(57) ABSTRACT

Without applying soldering or plasma arc welding, a lead wire is brought into connection with an eyelet easily and reliably so that lighting failure due to incomplete contact is prevented and cost saving is achieved. A base (7) has a screw form shell (8) and an eyelet (9). An end portion of the shell (8) is provided with the eyelet (9) via an insulator. A lead wire **(11*a*) supplying power is brought into connection with a portion of the eyelet (9)** at other than an outer surface of the eyelet.

11 Claims, 4 Drawing Sheets

LAMP WITH INTERNALLY ATTACHED EYELET LEAD, AND METHOD THEREFOR

FIELD OF THE INVENTION

The present invention relates to bulb-form lamps.

BACKGROUND OF THE INVENTION

In a conventional lamp such as a bulb-form fluorescent lamp, as shown in FIG. 6, a fluorescent tube 4, a lighting circuit 5 to light this fluorescent tube 4, and two lead wires 11*a* and 11*b* brought into connection with this lighting circuit 5 and supplying power thereto are housed in an envelope 19 comprising a globe 1 and a case 18.

At one end of the case 18, a base 20 is screwed in. This base 20 has a screw-form shell 20*a* and an eyelet 20*c* provided at one end of this shell 20*a* via glass-made insulator 20*b*. Portions respectively of the shell 20*a* and the eyelet 20*c* are embedded into the insulator 20*b*, and thereby the shell 20*a*, the insulator 20*b*, and the eyelet 20*c* are integrated.

One lead wire 11*a* is brought into connection with the base 20 on the outside, that is, onto the outer surface of the eyelet 20*c* by soldering.

Also, the lead wire 11*a* and the eyelet 20*c* are brought into connection by plasma arc welding from the environmental view point.

The manufacturing method of such a conventional lamp is as follows.

After an envelope 19, a fluorescent tube 4, and a lighting circuit 5 with which lead wires 11*a* and 11*b* are brought into connection are assembled by means of a normal method, the base 20 is screwed into one end portion of the case 18 and undergoes caulking to be fixed into the case 18. In that occasion, one lead wire 11*a* is arranged to be led out from a through hole 20*d* formed in the eyelet 20*c*. In addition, the portion led out from this lead wire 11*a* is brought into connection with the outer surface of the eyelet 20*c* by means of soldering or plasma arc welding.

However, in such a conventional lamp, in the case where the lead wire 11*a* is brought into connection with the eyelet 20*c*, flux (resin, etc.) used for soldering is formed as a film on the surface of soldering, and therefore, such a base 20 installed in a socket (not shown) of an illumination equipment causes the contact between the eyelet 20*c* and the socket to be incomplete. In addition, the eyelet 20*c* is corroded by this flux so that the eyelet 20*c* suffers from incomplete contact with the socket. There was a problem that due to such incomplete contact, lamps fail to be lighted.

In addition, there was a problem that the case where the lead wire 11*a* is brought into connection with the eyelet 20*c* by means of plasma arc welding gives rise to total costs since the plasma arc welding apparatus is expensive, requires a large installation space, and needs a lot of maintenance work.

The present invention has been achieved to solve these problems, and provides a low cost bulb-form lamp and a manufacturing method therefor, in which a lead wire is brought into connection with an eyelet easily and reliably without applying soldering or plasma arc welding, thereby preventing lighting failure due to incomplete contact is prevented.

DISCLOSURE OF THE INVENTION

A bulb-form lamp of the present invention includes a base having a screw form shell and an eyelet provided at an end portion of this shell via an insulator, and is configured so that a lead wire supplying power is brought into connection with a portion of the eyelet at other than the outer surface of the eyelet.

In addition, a first manufacturing method of a bulb-form lamp of the present invention is a method for manufacturing a bulb-form lamp including a base having a screw form shell and an eyelet provided in an end portion of this shell via an insulator, wherein a lead wire supplying power is brought into connection with a portion of the eyelet at other than the outer surface of the above described eyelet, comprising the steps of: leading out the lead wire from an eyelet receiving section formed in the insulator; bringing an end portion of the led out lead wire into connection with the eyelet; and fitting the eyelet into the eyelet receiving section.

The above described lamp and the manufacturing method therefor can bring the lead wire into connection with the eyelet easily and reliably without applying soldering or plasma arc welding and therefore, the failure of lighting due to incomplete contact can be prevented and cost saving can be achieved.

A second manufacturing method of the present invention is a method for manufacturing a bulb-form lamp including a base having a screw form shell and an eyelet provided at an end portion of this shell via an insulator, wherein a lead wire supplying power is brought into connection with a portion of the eyelet at other than the outer surface of the eyelet, comprising the steps of: leading out the lead wire from an eyelet receiving section formed in the insulator; disposing the led out lead wire along a side surface of the eyelet receiving section; fitting the eyelet into the eyelet receiving section; and sandwiching the lead wire between the eyelet and the insulator.

According to the above described manufacturing method, the lead wire can be brought into connection with the eyelet easily and reliably without applying soldering or plasma arc welding and therefore, the failure of lighting due to incomplete contact can be prevented and cost saving can be achieved. Also, without applying caulking or resistance welding, the lead wire can be brought into connection with the eyelet, and thus the manufacturing process can be simplified and production efficiency can be improved.

PREFERRED EMBODIMENTS

Preferred embodiments of the present invention will be described as follows with reference to accompanying drawings.

Figure 1:
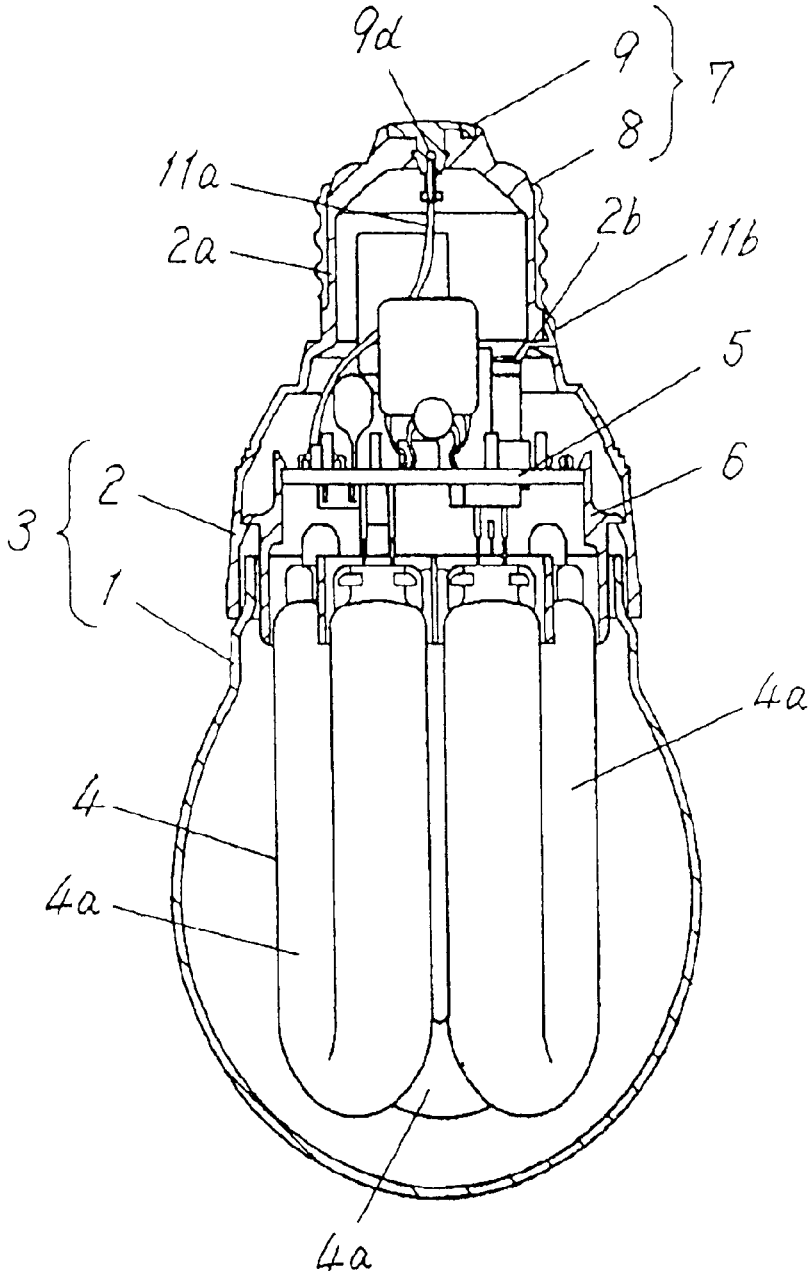
FIG. 1 is a partially cut away front view of a bulb-form fluorescent lamp according to a first embodiment of the present invention.

A bulb-form fluorescent lamp of the rated power of 13W according to a first embodiment of the present invention is sized with total length of 120 mm and with maximum outer diameter of 60 mm. As shown in FIG. 1, a fluorescent tube 4 with outer diameter of 11 mm with three U-form tubes 4*a* being brought into bridge connection forming one discharge route, a lighting circuit 5 to light this fluorescent tube 4, and a holder 6 holding an end portion of the fluorescent tube 4 and holding a lighting circuit 5 on the opposite end against the fluorescent tube 4 are housed inside an envelope 3 consisting of a transparent globe 1 and a case 2 made of resin. In addition, a cylindrical portion 2*a* formed in one end portion of the case 2 is provided with a base 7.

The both end portions of the fluorescent tube 4 are provided with electrodes (not shown). In addition, inside the fluorescent tube 4, predetermined quantities of respective mercury and rare gas are sealed in.

The base 7 consists of a screw-shaped shell 8 and a thrust-pin-shaped eyelet 9.

A portion of the case 2 is interposed between the shell 8 and the eyelet 9, and this portion of the case 2 functions as an insulator to insulate the shell 8 from the eyelet 9.

The shell 8 is fixed at a cylindrical section 2*a* of the case 2.

Figure 2:
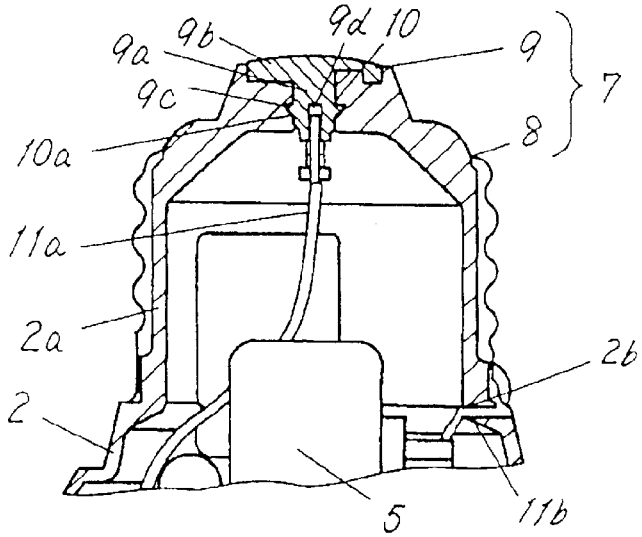
FIG. 2 is an enlarged sectional view of an essential part of the bulb-form fluorescent lamp.

As shown in FIG. 2, the eyelet 9 comprises a cylinder-shaped barrel section 9*a* with 7 mm length and 3 mm maximum outer diameter and a circular convex head portion 9*b* with 10 mm outer diameter at its outer periphery.

In addition, this eyelet 9 is fitted into the eyelet receiving section 10 formed at the tip of the cylinder section 2*a* of the case 2.

Moreover, a protruding engaging section 9*c* is provided on the side surface of the barrel section 9*a* of the eyelet 9. In addition, this engaging section 9*c* is engaged with a to-be-engaged portion 10*a* provided on the inner surface of the eyelet receiving section 10. Consequently, after the eyelet 9 is fitted into the eyelet receiving section 10, the eyelet 9 can be prevented from being removed from the eyelet receiving section 10.

The lighting circuit 5 is brought into connection with two lead wires 11*a* and 11*b* each having a conductor portion with 0.5 mm diameter. One lead wire 11*a* is inserted in a lead wire insertion section 9*d* formed inside the barrel section 9*a* of the eyelet 9 and in caulked so as to be brought into connection with the eyelet 9. Insertion section 9*d* formed inside the barrel section 9*a* is a blind hole, i.e., a hole having a closed end and a single open end that opens into the interior of the cylinder section 2*a* of the lamp. That is, the lead wire 11*a* is brought into connection with the eyelet 9 at a portion other than the outer surface. Here, the outer surface of the eyelet 9 refers to a surface facing a terminal of the socket contacting the eyelet 9 at the time when the base 7 is attached to the socket (not shown) of the illumination equipment.

In addition, the other end of the lead wire 11*b* is brought into connection with an end section of the shell 8 by soldering or the like on the side opposite from the eyelet 9 via a through hole 2*b* provided in the case 2.

Incidentally, the lead wire 11*a*, which is inserted into the lead wire insertion section 9*d*, is brought into connection with the eyelet 9 by caulking, or otherwise may be brought into connection by resistance welding instead of caulking.

Next a manufacturing method of such a bulb-form fluorescent lamp will be described as follows.

Following a normal method without any change, the case 2 and the globe 1 are attached and integrated with the fluorescent tube 4 and the lighting circuit 5 held by the holder 6. At the same time, the lead wire 11*a* is led out from the eyelet receiving section 10.

In addition, the led out lead wire 11*a* is inserted into the lead wire insertion section 9*d* of the eyelet 9 and they are caulked together for connection. Thereafter, the eyelet 9 connected with the lead wire 11*a* is fitted into the eyelet receiving section 10. Thus, the bulb-form fluorescent lamp is manufactured.

Incidentally, following a normal method without any change, the lead wire 11*b* is brought into connection with the shell 8.

According to the above described configuration of the present invention, the lead wire 11*a* can be brought into connection with the eyelet 9 easily and reliably without applying soldering or plasma arc welding and therefore, the lighting failure due to incomplete contact can be prevented and cost saving can be achieved.

In addition, the head 9*b* of the eyelet 9 is convexly shaped so that contact between the eyelet 9 and the socket of lighting equipment can be made in a further ensured manner.

Figure 3:
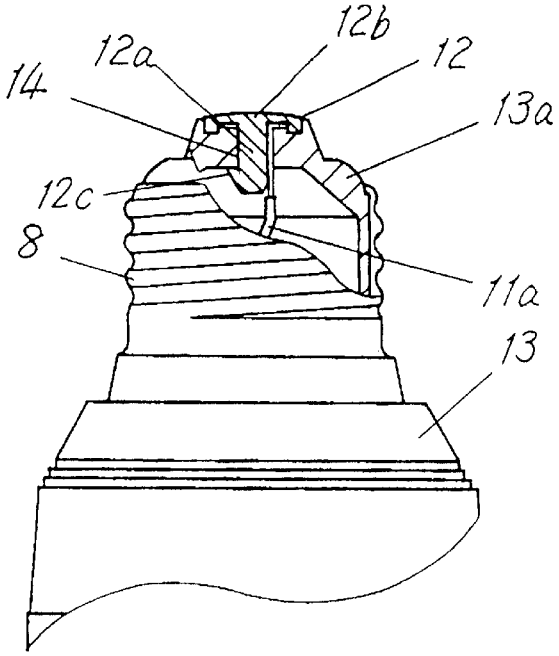
FIG. 3 is an enlarged sectional view of an essential part of a bulb-form fluorescent lamp according to a second embodiment of the present invention.

Next, a bulb-form fluorescent lamp according to a second embodiment of the present invention is configured the same as the bulb-form fluorescent lamp of the rated power 13 W according to the first embodiment of the present invention as shown in FIG. 3, with an exception that the lead wire 11*a* is sandwiched between the thrust-pin-shaped eyelet 12 and the case 13 that is in the eyelet receiving section 14.

The portion of the lead wire 11*a* being sandwiched is brought into an L-bent state.

The eyelet 12 has a cylinder-shaped barrel section 12*a* with 7 mm length and 3 to 6 mm outer diameter and a circular convex head portion 12*b* with 10 mm diameter at its outer periphery. Inside this barrel section 12*a*, no lead wire insertion section 9*d* as in the above described embodiment is provided.

A protruding engaging section 12*c* is provided on the side surface of the barrel section 12*a* of the eyelet 12. In addition, this engaging section 12*c* is engaged with the inner surface of the cylinder section 13*a* formed at an end section of the case 13. Thus, with the engaging section 12*c* being provided in the eyelet 12, after the eyelet 12 is fitted into the eyelet receiving section 14, the eyelet 12 can be prevented from being removed from the eyelet receiving section 14.

The manufacturing method of this bulb-form fluorescent lamp is as follows.

Following a normal method without any change, the case 13 and the globe 1 are attached and integrated with the fluorescent tube 4 and the lighting circuit 5 being held by the holder 6. Before the eyelet 12 is fitted into the eyelet receiving section 14, the lead wire 11*a* is disposed along the inner surface of the eyelet receiving section 14 in advance and then the eyelet 12 is fitted into the eyelet receiving section 14. Thereby, the lead wire 11*a* is sandwiched between the eyelet 12 and the case 13 that is in the eyelet receiving section 14, and brought into connection with the eyelet 12. Thus, the bulb-form fluorescent lamp is manufactured.

According to the above described configuration of the present invention, the lead wire 11*a* can be brought into connection with the eyelet 12 easily and reliably without applying soldering or plasma arc welding and therefore, the failure of lighting due to incomplete contact can be prevented and cost saving can be achieved. Also, without applying caulking or resistance welding, the lead wire 11*a* can be brought into connection with the eyelet 12, and thus the manufacturing can be simplified and production efficiency can be improved.

In addition, the lead wire 11*a* is sandwiched in an L-bent state so that the lead wire 11*a* is less liable to be removed from the location between the eyelet 12 and the eyelet receiving section 14 or the tip end of the case 13.

Figure 4:
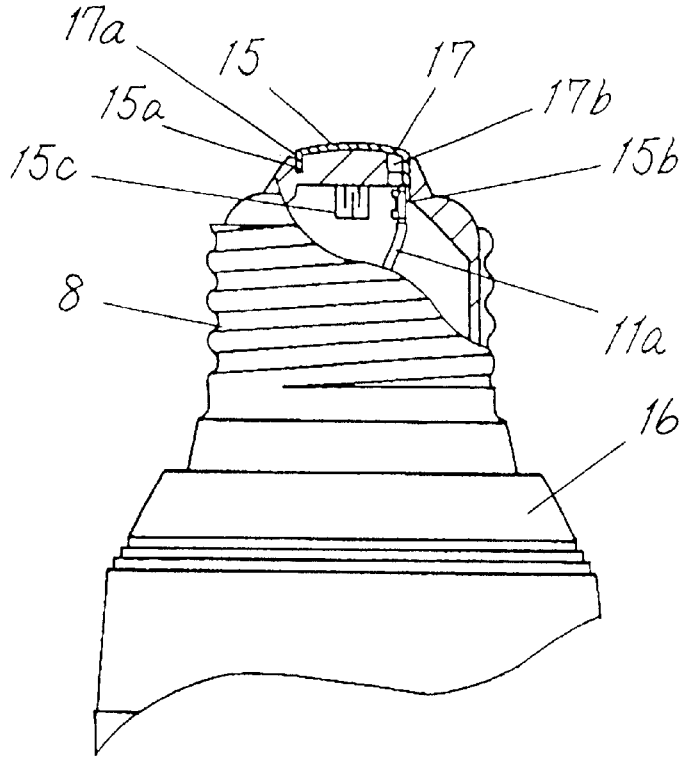
FIG. 4 is an enlarged sectional view of an essential part of a bulb-form fluorescent lamp according to a third embodiment of the present invention.
Figure 5:
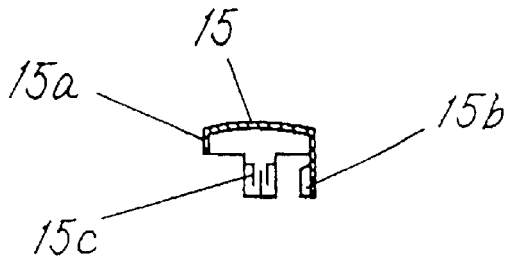
FIG. 5 is a front section of an eyelet for use in the bulb-form fluorescent lamp.
Figure 6:
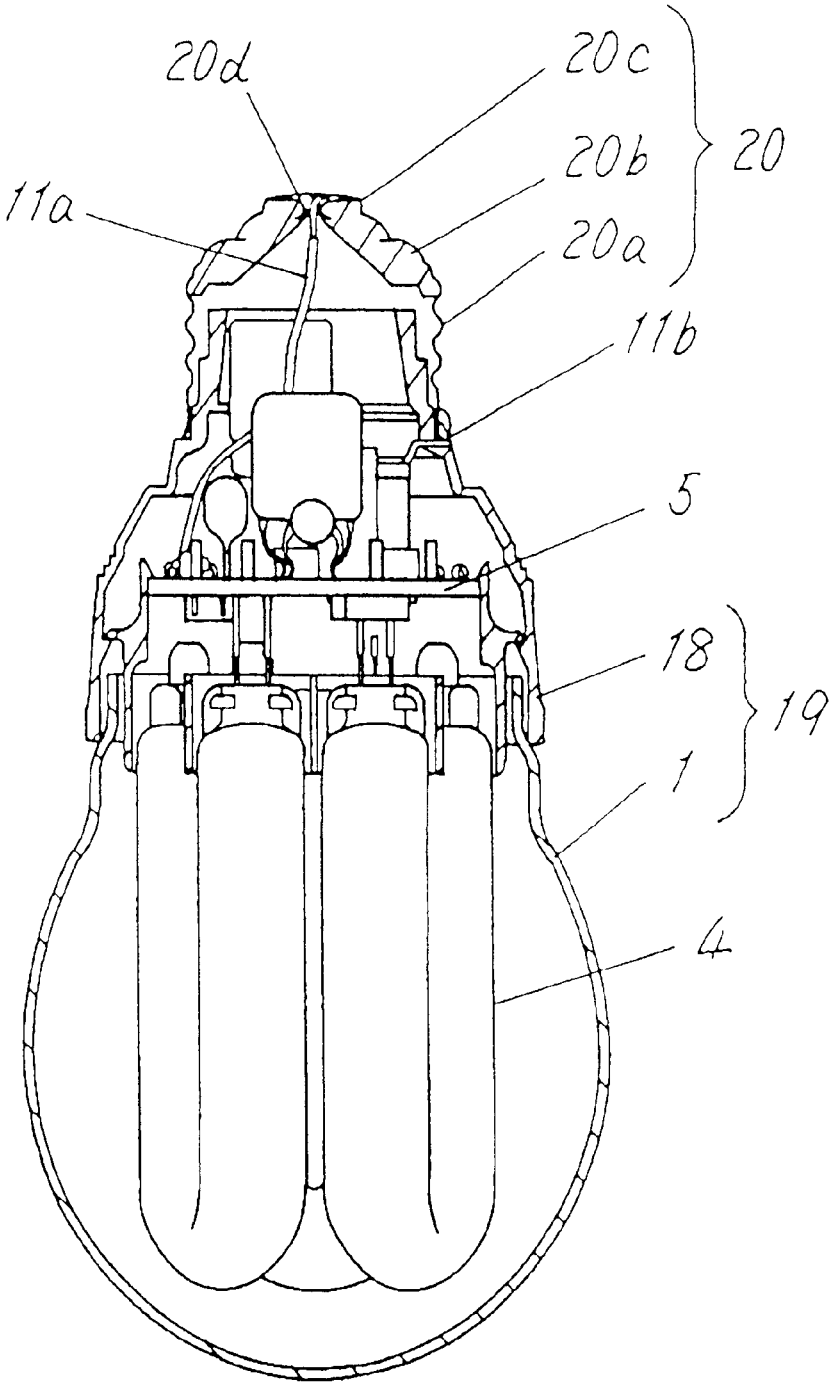
FIG.6 PRIOR ART
FIG. 6 is a partially cut away front view of a conventional bulb-form fluorescent lamp.

Next, a bulb-form fluorescent lamp according to a third embodiment of the present invention is configured the same as the bulb-form fluorescent lamp of the rated power 13 W according to the first embodiment of the present invention as shown in FIG. 4 and FIG. 5, with an exception that the eyelet 15 formed with a plate member concavely press-molded is fitted into the eyelet receiving section 17 of the case 16.

The eyelet 15 has a thickness of 0.3 mm to 1.0 mm.

As shown in FIG. 4, an lead wire insertion section 15*b* is provided on part of an outer periphery 15*a* of an eyelet 15. The lead wire 11*a* is, for example, inserted into this lead wire insertion section 15*b* and caulked so as to be brought into connection with the eyelet 15.

In addition, a plate form engaging section 15*c* is provided on the outer periphery of the eyelet 15. This engaging section 15*c* is bent inward a little after being inserted into a through hole 17*b* to be described later. Thus bent engaging section 15*c* can serve to prevent removal of the eyelet receiving section 17 from the eyelet 15.

This eyelet receiving section 17 is provided with a dent 17*a* into which the outer periphery section 15*a* is fitted, a through hole section 17*b* into which the lead wire insertion section 15*b* is thrust, and a through hole section (not shown) into which the engaging section 15*c* is thrust.

The manufacturing method of this bulb-form fluorescent lamp is the same as for the bulb-form fluorescent lamp according to the first embodiment of the present invention.

According to the above described configuration, the lead wire 11*a* can be brought into connection with the eyelet 15 easily and reliably without applying soldering or plasma arc welding and therefore, the failure of lighting due to incomplete contact can be prevented. Also, since the eyelet 15 can be easily formed, cost saving can be achieved.

Although the case where the lead wire 11*a* is inserted into the lead wire insertion section 15*b* and undergoes caulking has been described in the foregoing third embodiment, in other cases, for example, where the lead wire 11*a* is sandwiched between the eyelet 15 and the case 16 or where the lead wire 11*a* undergoes resistance welding to be connected to the eyelet 15, the same effect as described above can be afforded.

The bulb-form fluorescent lamp has been described in the foregoing first to third embodiments, but without limiting to this, all types of lamps using a base, such as incandescent lamps, reflector lamps or high-pressure discharge lamps, can also afford the same effect as described above.

What is claimed is:

1. A bulb-form lamp comprising a base having a screw-form shell and an eyelet provided at an end portion of the shell via an insulator wherein:

a lead wire insertion section of the eyelet has an attached lead wire for supplying power, and the base comprises a through hole, the hole having located therein the lead wire insertion section and attached lead wire, wherein the attached lead wire extends from an eyelet portion other than the outer surface of the eyelet into the interior of the lamp.

2. The lamp according to claim 1, further comprising caulking applied to the attached lead wire, thereby connecting the lead wire with the eyelet.

3. The lamp according to claim 1, wherein the lead wire and the eyelet are brought into connection by applying resistance welding.

4. The lamp according to claim 1, wherein the eyelet comprises an engaging section for engagement with the insulator.

5. The lamp according to claim 1, wherein the eyelet is formed by concavely press-molding a plate member.

6. The lamp according to claim 1, wherein the eyelet has a convex shaped head.

7. The lamp according to claim 1, further including a lighting circuit to light a fluorescent tube, and a case housing the lighting circuit, wherein the lead wire is brought into connection with the lighting circuit and the insulator is a part of the case.

8. The lamp according to claim 1, wherein said eyelet comprises an engaging section for locking engagement in a hole located in the insulator.

9. A manufacturing method of a bulb-form lamp including a base having a screw form shell and an eyelet located at an end portion of the shell via an insulator, comprising:

leading out a lead wire from an eyelet receiving section formed in the insulator;

attaching an end portion of the led out lead wire to the eyelet at a portion of the eyelet other than the outer surface of the eyelet; and fitting the eyelet into the eyelet receiving section.

10. The manufacturing method according to claim 9, further comprising connecting the lead wire to the eyelet by resistance welding.

11. The manufacturing method according to claim 9, further comprising forming an eyelet by concavely press-molding a plate member.

* * * * *